US010184367B2

(12) United States Patent
Cathcart et al.

(10) Patent No.: US 10,184,367 B2
(45) Date of Patent: Jan. 22, 2019

(54) ENGINE LUBRICATION SYSTEM

(71) Applicant: Orbital Australia Pty Ltd, Balcatta, Western Australia (AU)

(72) Inventors: Geoffrey Paul Cathcart, Mount Lawley (AU); Donald Andrew Railton, Duncraig (AU)

(73) Assignee: ORBITAL AUSTRALIA PTY LTD, Balcatta (AU)

( * ) Notice: Subject to any disclaimer, the term of this patent is extended or adjusted under 35 U.S.C. 154(b) by 0 days.

(21) Appl. No.: 14/614,698

(22) Filed: Feb. 5, 2015

(65) Prior Publication Data

US 2015/0218979 A1 Aug. 6, 2015

(51) Int. Cl.

| | |
|---|---|
| ***F01M 1/02*** | (2006.01) |
| ***F01M 1/18*** | (2006.01) |
| ***F01M 11/00*** | (2006.01) |
| ***F04B 17/04*** | (2006.01) |
| *F02B 75/02* | (2006.01) |

(52) U.S. Cl.

CPC ..... *F01M 1/02* (2013.01); *F01M 1/18* (2013.01); *F01M 11/0004* (2013.01); *F04B 17/04* (2013.01); *F01M 2001/0223* (2013.01); *F02B 2075/025* (2013.01)

(58) Field of Classification Search

CPC .. F01M 1/18; F01M 1/20; F01M 1/16; F01M 2005/028; F01M 13/028; F01M 11/0004; F01M 1/02; F04B 17/04

See application file for complete search history.

(56) References Cited

U.S. PATENT DOCUMENTS 4,846,307 A * 7/1989 Kinouchi ..... F02B 61/045 123/196 CP 7,905,325 B1 3/2011 Wedlake et al.

(Continued)

FOREIGN PATENT DOCUMENTS

| | | |
|---|---|---|
| GB | 2225817 A | 6/1990 |
| GB | 2280933 A | 2/1995 |
| JP | H0633723 A | 2/1994 |

OTHER PUBLICATIONS

Australia International Search Report dated Jul. 7, 2014, Serial No. 2014900335.

*Primary Examiner* — Jacob Amick

(74) *Attorney, Agent, or Firm* — Harness, Dickey & Pierce, P.L.C.

(57) ABSTRACT

A system and method for delivering lubrication oil to an internal combustion engine. The engine lubrication system (10) comprises a lubrication oil reservoir (13), a pump (15) to deliver lubrication oil to the engine from the reservoir (13), and a pressurization system (17) for pressurizing oil received by the pump from the reservoir for delivery to the engine. The pressurization establishes a positive pressure at the pump inlet to assist delivery of oil having entrained vapor cavities to the engine for lubrication thereof. The pump (15) comprises a solenoid actuated positive displacement pump, whereby operation of the pump may be selectively controlled by the manner in which the solenoid is operated. The engine lubrication system (10) further comprises a pressure release system (46) comprising pressure relief valve (47) for relieving excess fluid pressure within the oil reservoir (13).

35 Claims, 8 Drawing Sheets

(56) References Cited

U.S. PATENT DOCUMENTS

| | | | | |
|---|---|---|---|---|
| 2010/0192899 | A1* | 8/2010 | Ni | F01M 1/16<br>123/196 S |
| 2010/0229823 | A1* | 9/2010 | Gibson | F01M 1/12<br>123/196 R |
| 2013/0183173 | A1* | 7/2013 | Kohli | F04B 35/045<br>417/410.1 |

* cited by examiner

ENGINE LUBRICATION SYSTEM

TECHNICAL FIELD

This application claims the benefit and priority of Australian Patent Application 2014900335, filed Feb. 5, 2014. The entire disclosure of the above application is incorporated herein by reference.

The present invention relates to engine lubrication. More particularly, the invention is concerned with a system and method for delivering lubrication oil to an internal combustion engine.

The present invention has been devised particularly, although not necessarily solely, for delivering lubrication oil to a two-stroke internal combustion engine. However, it should be understood that the invention may have application to other internal combustion engines, including in particular four-stroke engines and rotary (Wankel) engines.

Furthermore, the invention has been devised particularly, although not necessarily solely, for use with an engine of an unmanned aerial vehicle (UAV).

BACKGROUND

The following discussion of the background art is intended to facilitate an understanding of the present invention only. The discussion is not an acknowledgement or admission that any of the material referred to is or was part of the common general knowledge as at the priority date of the application.

As mentioned above, the invention is particularly applicable to a lubrication system for a two-stroke internal combustion engine of a UAV. Accordingly, the invention will primarily be discussed in relation to that application. However, it should be understood that the invention may have application to various other machines, apparatus and devices having internal combustion engines which require lubrication.

The lubrication requirements for a two-stroke engine of a UAV are provided by way of a lubrication system comprising a pump for pumping lubrication oil to various parts of the engine, including for example the engine crankcase. The pump is connected to an oil supply, typically in the form of a reservoir such as a tank. The reservoir provides a supply of oil to the pump as required.

Typically, the pump is a positive displacement pump actuated by a solenoid.

It has been found that in such an engine lubrication system, the pump may not necessarily supply oil in a reliable manner to the engine in certain circumstances. This can lead to engine failure and may have catastrophic consequences for the UAV.

In particular, it has been found that in certain circumstances vapour cavities form in the oil. The vapour cavities may comprise air bubbles and voids arising from coalescence of air bubbles in the oil.

There are various reasons as to why vapour cavities may form in the oil, including agitation of the oil arising through, for example, operation of the UAV in turbulent flight conditions or at high altitude conditions in which ambient atmospheric pressure is relatively low such that the oil undergoes a phase change, and also cavitation associated with the pump.

The presence of vapour cavities in the oil can detrimentally affect operation of the pump, causing the supply of oil to the engine to be interrupted. In particular, the vapour cavities may block or at least retard flow of the oil into the pump. Furthermore, vapour cavities present within the pumping chamber of the pump may compress or collapse during a pump delivery stroke, thereby rendering the pump delivery stroke ineffective as it relies on volume compression of the otherwise incompressible oil.

It is against this background, and the problems and difficulties associated therewith that the present invention has been developed.

SUMMARY OF INVENTION

According to a first aspect of the invention, there is provided an engine lubrication system comprising a lubrication oil reservoir, a pump to deliver lubrication oil to the engine from the reservoir, and a pressurisation system for pressurising oil received by the pump from the reservoir for delivery to the engine, whereby the pressurisation establishes a positive pressure at the pump inlet to assist delivery of oil having entrained vapour cavities to the engine for lubrication thereof, wherein the pump comprises a solenoid actuated positive displacement pump.

With this arrangement, oil is more reliably pumped to the engine even in circumstances where entrained vapour cavities are present in the lubrication oil.

Further, pressurisation of the lubrication oil may improve the metering accuracy of pumped fluid comprising lubrication oil having entrained vapour cavities.

The solenoid actuated positive displacement pump is believed to be beneficial in that operation of the pump may be selectively controlled by the manner in which the solenoid is operated. By way of example, in one mode of operation of the pump, the displacement stroke of the pump may be controlled linearly (that is the stroke length of the pump may be selectively variable) by controlling the electrical control signal input for operation of the solenoid. In another mode of operation of the pump, the stroke rate of the pump may be controlled by controlling the electrical control signal input for operation of the solenoid. The control of the electrical signal input for the solenoid may be performed in any appropriate way as would be understood by a person skilled in the art; for example, the control may be by way of pulse width modulation or pulse frequency modulation.

With this arrangement, the pumping operation of the pump can be regulated according to vapour cavity entrainment within the lubrication oil; that is, for example, according to the extent and nature of entrained vapour cavities in the lubrication oil being delivered by the pump. There may, for example, be circumstances in which it is beneficial to deliver the lubrication oil using pumping strokes of different lengths; that is, in some cases it may be advantageous to use relatively longer pumping strokes and in other cases relatively shorter pumping strokes. This can be achieved by appropriate variation of the stroke length through regulating the electrical control signal input for operation of the solenoid. There may also, for example, be circumstances in which it is beneficial to deliver the lubrication oil using pumping strokes at different rates; that is, in some cases it may be advantageous to use faster pumping strokes and in other cases slower pumping strokes. This can be achieved by appropriate variation of the stroke rate through regulating the electrical control signal input for operation of the solenoid. A combination of variation in both stroke length and stroke rate may also be performed; for example, a pumping action involving relatively fast, short pumping strokes or a pumping action involving relatively short, long strokes, or a pumping action involving any other combination of stroke rate and stroke length.

The solenoid actuated positive displacement pump constitutes an electromagnetically actuated reciprocating pump.

The positive displacement pump may comprise a piston pump. With this arrangement, the pump comprises an electromagnetically actuated reciprocating piston pump.

The electromagnetically actuated reciprocating piston pump may comprise a pumping chamber and a piston, the piston being adapted for reciprocatory movement for varying the volume of the pumping chamber.

The piston is movable in a first direction under the influence of an electromagnetic force delivered by the solenoid and is movable in a second (return) direction under the influence of a return mechanism. The return mechanism may comprise a resilient compression element such as a spring which is causes to undergo compression upon movement of the piston in the first direction under the influence of the solenoid and which provides a restoring force for return of the piston in the second direction. With this arrangement, the piston can undergo reciprocatory movement in the first and second directions under the combined effects of the electromagnetic force delivered by the solenoid and the return force delivered by the return mechanism.

An electronic control system may be provided for controlling actuation of the solenoid, with the control system being operable to regulate the electrical control signal input for operation of the solenoid according to when, and the manner in which, the pump is required to operate.

The engine may have an engine management system comprising an electronic control unit (ECU). The solenoid may be connected to the ECU, with the ECU being operable to perform the function of the control system for the solenoid.

The pump may further comprise an inlet and outlet communicating with the pumping chamber, and a valve system for controlling oil flow into and out of the pumping chamber. The valve system may comprise an inlet valve associated with the inlet, and an outlet valve associated with the outlet. The inlet and outlet valves may comprise check valves.

Preferably, the pressurisation system is configured to pressurise oil within the oil reservoir.

Oil within the reservoir may be pressurised by fluid pressure within or acting upon the oil reservoir.

The fluid pressure may be generated from a pressure source in fluid communication with the oil reservoir.

As alluded to above, pressurisation of the oil reservoir may improve the metering accuracy when pumping lubrication oil having entrained vapour cavities.

Preferably, the system further comprises a fluid pressure delivery path extending between the pressure source and the oil reservoir, and a valve in communication with the delivery path to permit fluid flow from the pressure source to the oil reservoir while restricting fluid flow in the opposition direction.

Typically, the valve comprises a check valve.

The oil reservoir is pressurised to a pressure condition above the local atmospheric pressure in order to achieve a desired outcome; namely, to establish a positive pressure at the pump inlet to reduce, or eliminate, the adverse effect of any vapour cavities present in the oil during a pumping operation performed by the pump. Typically, the oil reservoir is pressurised to a pressure condition within the range of about 10 to 15 kPa above ambient pressure. Advantageously, the pressure condition is normally within the range of about 10 to 12 kPa, increasing to about 13 kPa at full engine speed. At these pressures, it has been found that there is a small increase (of about 5%) in the volume of oil delivered. It should, however, be appreciated that the invention need not necessarily be limited to the pressure or pressure range specified in order to achieve the same or substantially the same outcome.

Preferably, the system further comprises a pressure release system for relieving excess fluid pressure within the oil reservoir.

The pressure release system may comprise a pressure relief valve.

In one arrangement, the pressure relief valve may communicate with the fluid pressure delivery path extending between the pressure source and the oil reservoir. In another arrangement, the pressure relief valve may communicate directly with the oil reservoir.

This pressure relief is for the purpose of ensuring that oil flow to the pump is not at such a high pressure as would cause oil flow through the oil pump when the latter is not operating. Oil leakage through the oil pump in such circumstances would be uncontrollable and would likely disrupt the integrity of the air/fuel mixture supply for the engine when the engine is next started, and also possibly interfere with emission controls implemented for the engine.

The pressure relief valve is set to vent fluid pressure exceeding a predetermined pressure level. Typically, the pressure relief valve is set to vent fluid pressure exceeding about 15 kPa above ambient pressure. However, it should be appreciated that the invention need not necessarily be limited to this pressure relief value, as other pressure relief values may achieve the same or substantially the same outcome.

The system according to the first aspect of the invention may be retrofitted to an existing engine or may be fitted on an OEM basis to an engine.

The engine may comprise a two-stroke direct injection engine.

According to a second aspect of the invention there is provided a pressurisation system operable to pressurise oil flowing to an oil pump within an engine lubrication system, the pressurisation system comprising a source of fluid pressure and a fluid flow path between the source of fluid pressure and an oil reservoir from which lubrication oil can flow to the oil pump, whereby the pressurisation establishes a positive pressure at the pump inlet to assist delivery of lubrication oil having entrained vapour cavities to the engine for lubrication thereof, and a pressure release system for relieving excess fluid pressure upon the oil to be delivered by the oil pump.

The pressurisation system according to the second aspect of the invention may be configured to pressurise oil within the oil reservoir.

Oil within the reservoir may be pressurised by fluid pressure within or acting upon the oil reservoir.

The fluid pressure may be generated from a pressure source in fluid communication with the oil reservoir.

The pressurisation system may be retrofitted to an engine lubrication system having a lubrication oil reservoir and an oil pump for pumping lubrication oil from the reservoir to the engine.

In such circumstances, the pressurisation system would typically use the existing oil pump and possibly also the existing oil reservoir of the engine lubrication system. In circumstances where the existing oil reservoir of the engine lubrication system is used, that oil reservoir may require modification whereby it is sealed to facilitate pressurisation of lubrication oil contained therein.

According to a third aspect of the invention there is provided a method of lubricating an engine using an engine lubrication system according to the first aspect of the invention.

According to a fourth aspect of the invention there is provided a method of delivering lubrication oil to an engine comprising pressurising a supply of the lubrication oil to be received by a pump, and operating the pump to deliver lubrication oil to the engine, wherein the pressurisation of the lubrication oil establishes a positive pressure at the pump inlet to assist delivery of lubrication oil having entrained vapour cavities, and wherein operation of the pump is selectively variable according to vapour cavity entrainment within the lubrication oil.

The method may further comprise use of a solenoid actuated positive displacement pump as said pump, wherein selective variation of operation of the pump may comprise at least one of varying the stroke length and stroke rate of a pumping cycle performed by the pump.

According to a fifth aspect of the invention there is provided a method of delivering lubrication oil to an engine comprising pressurising a supply of the lubrication oil to be received by a pump, and operating the pump to deliver lubrication oil to the engine, wherein the pressurisation of the lubrication oil establishes a positive pressure at the pump inlet to assist delivery of lubrication oil having entrained vapour cavities, and wherein the method further comprises relieving excess fluid pressure upon the oil to be delivered by the oil pump.

According to a sixth aspect of the invention there is provided a method of delivering lubrication oil to an engine comprising pressurising a supply of the lubrication oil to be received by a pump, and operating the pump to deliver lubrication oil to the engine, wherein the pressurisation of the lubrication oil establishes a positive pressure at the pump inlet to assist delivery of lubrication oil having entrained vapour cavities, wherein the pressurisation of the lubrication oil improves the metering accuracy of the pumped oil and wherein operation of the pump is selectively variable according to vapour cavity entrainment within the lubrication oil.

According to a seventh aspect of the invention there is provided a method of delivering lubrication oil to an engine comprising pressurising a supply of the lubrication oil to be received by a pump, and operating the pump to deliver lubrication oil to the engine, wherein the pressurisation of the lubrication oil establishes a positive pressure at the pump inlet to assist delivery of lubrication oil having entrained vapour cavities, wherein the pressurisation of the lubrication oil improves the metering accuracy of the pumped oil and wherein the method further comprises relieving excess fluid pressure upon the oil to be delivered by the oil pump.

According to an eighth aspect of the invention, there is provided an engine lubrication system comprising a lubrication oil reservoir, a pump to deliver lubrication oil to the engine from the reservoir, and a pressurisation system for pressurising oil received by the pump from the reservoir for delivery to the engine, whereby the pressurisation establishes a positive pressure at the pump inlet to assist delivery of oil having entrained vapour cavities to the engine for lubrication thereof, wherein the pump comprises an electronic oil pump.

The electronic oil pump may comprise an electromagnetically actuated pump.

The electromagnetically actuated pump may comprise an electromagnetically actuated reciprocating piston pump.

The electromagnetically actuated reciprocating piston pump may comprise a solenoid actuated positive displacement pump.

According to a ninth aspect of the invention, there is provided an engine lubrication system according to the first aspect of the invention.

According to a tenth aspect of the invention, there is provided a two-stroke direct injection engine, the engine comprising a combustion chamber to receive fuel for combustion by direct injection, and a lubrication system for delivery of lubrication oil to the engine, the lubrication system comprising an engine lubrication system according to the first aspect of the invention.

With this arrangement, lubrication oil can be delivered to the combustion chamber separately of the fuel from a separate oil reservoir providing a total loss system.

BRIEF DESCRIPTION OF THE DRAWINGS

Further features of the present invention are more fully described in the following description of several non-limiting embodiments thereof. This description is included solely for the purposes of exemplifying the present invention. It should not be understood as a restriction on the broad summary, disclosure or description of the invention as set out above. The description will be made with reference to the accompanying drawings in which.

In the drawings, like structures are referred to by like numerals throughout the various views. The drawings shown are not necessarily to scale, with emphasis instead generally being placed upon illustrating the principles of the present invention.

Figure 1:
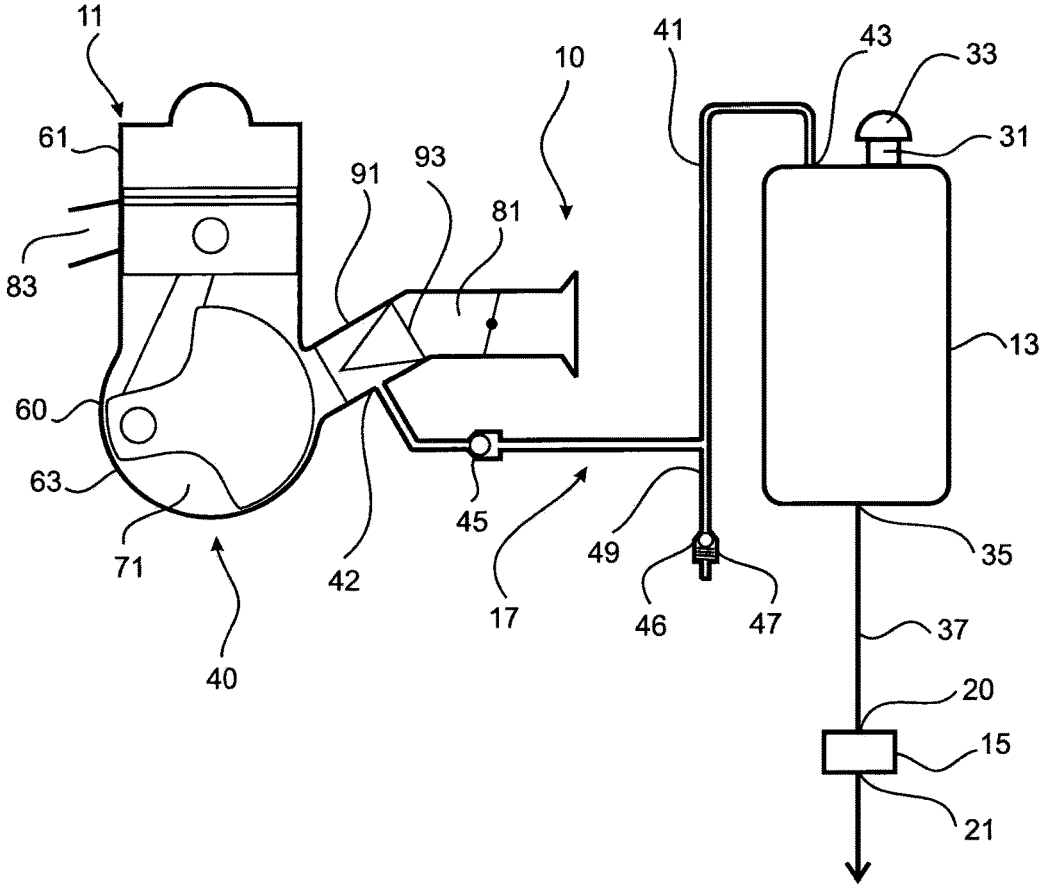
FIG. 1 is a schematic view of a first embodiment of the engine lubrication system according to the invention fitted to a two-stroke engine.

The figures depict various embodiments of the invention. The embodiments illustrate certain configurations; however, it is to be appreciated that the invention can take the form of many configurations, as would be obvious to a person skilled in the art, while still embodying the present invention. These configurations are to be considered within the scope of the invention.

DETAILED DESCRIPTION OF EMBODIMENTS

The various embodiments are each directed to an engine lubrication system 10 for an engine 11 of a UAV. In the arrangements shown, the engine 11 comprises a crankcase compression two-stroke engine. In particular, the engine may comprise a two-stroke direct injection engine. However, the engine lubrication system according to the invention can be adapted for use with other types of engines, including other two-stroke engines and also four-stroke engines. Further, the engine lubrication system according to the invention need not necessarily be limited to application with an engine for a UAV and may find other applications. The other applications may be in relation to aircraft, as well as machines, apparatus and devices which have engines with lubrication requirements.

The engine lubrication system 10 comprises an oil reservoir configured as a tank 13, an oil pump 15 for receiving oil from the tank 13 for delivery of a supply of oil to the engine, and a pressurisation system 17 for pressurising oil in the tank 13 to assist supply of oil to the oil pump 15 and also passage of the oil through the oil pump 15 under a pumping action.

In the embodiments described, the engine lubrication system 10 is assembled by retrofitting the pressurisation system 17 to an existing engine 11, and utilising the original oil pump 15 and oil tank 13 of the engine. In some cases there may be a need for some modification to the engine to accommodate the pressurisation system 17, as will be explained later. The engine lubrication system 10 may alternatively be supplied as an integrated unit with the engine; that is, the engine lubrication system 10 could be installed on the engine on an OEM basis, with the oil tank 13, oil pump 15 and pressurisation system 17 integrated with the engine as originally supplied.

The oil pump 15 comprises an electronic pump which is actuated electromagnetically. Other pump arrangements are, of course, possible.

Figure 3:
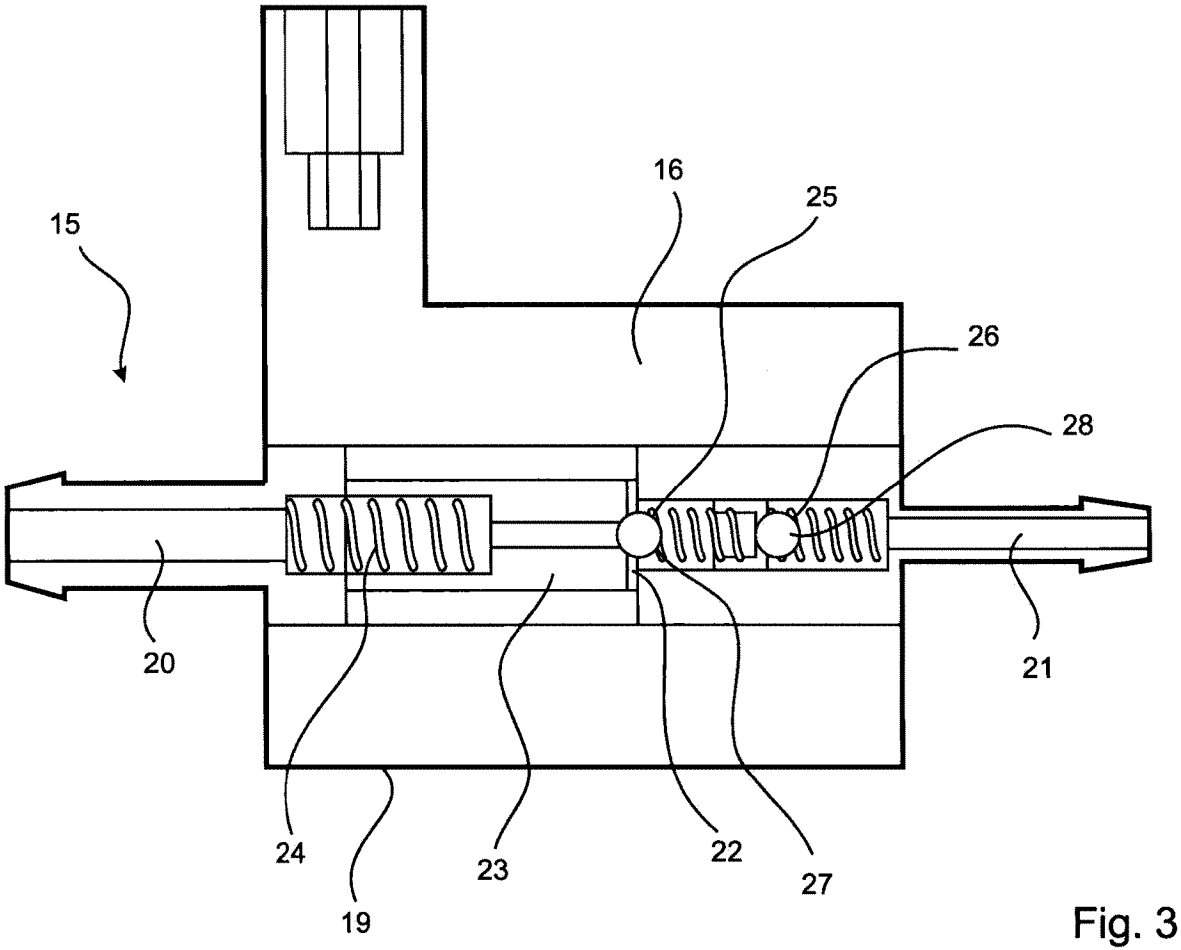
FIG. 3 is a schematic sectional view of an oil pump forming part of the lubrication system of the first embodiment.

In the embodiments described and illustrated, the pump 15 is in the form of a positive displacement pump actuated by a solenoid 16. The pump 15, which is best seen in FIG. 3, is of known kind and comprises a pump body 19 having an inlet 20 to receive a supply of oil from the tank 13 and an outlet 21 for delivery of the oil to the engine 11. The pump body 19 includes a pumping chamber 22 and a piston 23, the piston 23 being adapted for reciprocatory movement (back-and-forth) for varying the volume of the pumping chamber 22. The piston 23 comprises a shuttle piston freely movable back-and-forth, the movement comprising movement in a first direction under the influence of an electromagnetic force delivered by the solenoid 16 and movement in a second (return) direction under the influence of a return mechanism 24. In the arrangement shown, the return mechanism 24 comprises a resilient element in the form of a tension spring which is caused to undergo extension upon movement of the piston in the first direction under the influence of the solenoid 16 and which provides a restoring force for returning the piston 23 in the second direction. With this arrangement, the piston 23 can undergo reciprocatory movement in the first and second directions under the combined effects of the electromagnetic force delivered by the solenoid 16 and the return force delivered by spring 24 under tension. Other return mechanisms are, of course, possible; for example, the return mechanism 24 may comprises a resilient element in the form of a compression spring which is caused to undergo compression upon movement of the piston 23 in the first direction under the influence of the solenoid 16 and which provides a restoring force delivered by the spring under compression for returning the piston 23 in the second direction.

The solenoid 16 comprises an electromagnetic coil 25 which, when energised, is operable in combination with the piston 23 to generate an electromagnetic force which drives the piston in the first direction to perform a pumping stroke displacing oil from the pumping chamber 22.

The pump 15 further comprises a valve system 26 for controlling oil flow into and out of the pumping chamber 22. The valve system 26 comprises an inlet valve 27 associated with the inlet 20, and an outlet valve 28 associated with the outlet 21. The inlet and outlet valves 27, 28 may comprise check valves.

The engine may have an engine management system comprising an electronic control unit (ECU). The solenoid may be connected to the ECU, with the ECU being operable for controlling actuation of the solenoid 16 and regulating an electrical control signal input for energising the solenoid to cause operation of the solenoid according to when, and the manner in which, the pump is required to operate.

The oil tank 13 has an inlet 31 through which the tank can be filled with oil as necessary. The inlet 31 has a closure 33 such as a cap which can sealingly engage the inlet to provide a sealed environment within the tank to facilitate pressurisation of the tank, as will be explained later.

The oil tank 13 has an outlet 35 which communicates with the inlet 20 of the pump 15 via an oil flow line 37. Oil is then delivered from the oil pump 15 via an outlet 21.

The pressurisation system 17 is operable to pressurise oil in the tank 13 to assist delivery of the oil to the oil pump 15. More particularly, the pressurisation system 17 is operable to establish a positive pressure at the inlet 20 of the oil pump 15 to reduce, or eliminate, the effect of any vapour cavities such as air bubbles present in the oil during a pumping operation performed by the pump 15. Specifically, the positive pressure ensures that, during operation of the pump 15, oil flows to the pump inlet 20 and passes through the pump 15 under a pumping action, notwithstanding the presence of any vapour cavities such as air bubbles within the oil. In this way, the pump 15 is able to reliably deliver oil to the engine 11 throughout the full range of operating conditions to which the engine is likely to be exposed. As explained earlier, vapour cavities such as air bubbles may form in the oil for various reasons, including agitation of the oil in circumstances where the UAV is operating in turbulent conditions, high altitude conditions in which ambient atmospheric pressure is relatively low, and cavitation within the oil pump. In the absence of the positive pressure, there is a real possibility that oil would not be reliably supplied to the engine in certain circumstances, leading to potential engine failure and catastrophic consequences for the UAV.

Further, pressurisation of the oil tank 13 leads to an improvement in the metering accuracy of the pump 15 when pumping lubrication oil having entrained vapour cavities.

The oil tank 13 is pressurised to a pressure condition above the local atmospheric pressure. Typically, the oil tank 13 is pressurised to a pressure condition within the range of about 10 to 15 kPa above ambient pressure. Advantageously, the pressure condition is normally within the range of about 10 to 13 kPa, increasing to about 14 kPa at full engine speed.

With this arrangement, it is expected that delivery of oil to the engine 11 will be reliable while the UAV is in flight. Indeed, it is expected that delivery of oil to the engine 11 will be reliable even at atmospheric pressure conditions which are much lower than would likely be experienced in flight.

It should be noted that in certain arrangements the actual operating pressure of the oil tank 13 could be optimised for the type of oil pump in use or to suit specific engine operating conditions. For example, such optimisation could be achieved by adjusting the operating pressure of the pressurised tank by using a particular pressure relief arrangement associated with the oil tank 13.

The pressurisation system 17 comprises a source of fluid pressure 40 communicating with the oil tank 13 via a fluid pressure flow path in the form of a fluid pressure supply line 41. The fluid pressure supply line 41 has an inlet 42 communicating with the fluid pressure source 40 and an outlet 43 communicating with the oil tank 13. Preferably, the outlet 43 is disposed at the top or at an upper region of the tank 13 so as to be above the oil level within the tank when the tank is full of oil.

The fluid pressure source 40 may take various forms, as will be described later in relation to various embodiments of the invention. In each case, the fluid supplied by the fluid pressure source 40 is a compressed gas or gaseous fluid mixture, typically compressed air.

A valve 45 is associated with the fluid pressure supply line 41 to permit fluid flow from the fluid pressure source 40 to the oil tank 13 while inhibiting flow in the reverse direction. This prevents reverse flow out of the oil tank 13 to the fluid pressure source 40. In the various embodiments illustrated, the valve 45 comprises a one-way check valve.

The pressurisation system 17 further comprises a pressure release system 46 for relieving excess fluid pressure within the oil tank 13. The pressure release system 46 may comprise a pressure relief valve 47 for limiting the pressure within the oil tank 13. This pressure relief is for the purpose of ensuring that oil in oil flow line 37 is not at such a high pressure as would cause oil flow through the oil pump 13 when the latter is not operating. Oil leakage through the oil pump 13 in such circumstances would be uncontrollable and would likely disrupt the integrity of the air/fuel mixture supply for the engine when the engine is next started, and also possibly interfere with emission controls implemented for the engine.

In the various embodiments, the pressure relief valve 47 is set to vent fluid pressure exceeding a predetermined the pressure level. Typically, the pressure relief valve 47 is set to vent fluid pressure exceeding about 15 kPa.

In the various embodiments illustrated, the pressure relief valve 47 comprises a one-way check valve installed in a branch line 49 connected to the fluid pressure supply line 41. The pressure relief valve 47 could, of course, be provided at any other suitable location; for example, it may be integral with the oil tank 13.

The engine lubrication system 10 provides an arrangement for more reliably pumping oil to the engine even in circumstances where entrained vapour cavities are present in the lubrication oil.

Further, pressurisation of the lubrication oil may improve the metering accuracy of pumped fluid comprising lubrication oil having entrained vapour cavities.

The solenoid actuated positive displacement pump 15 is believed to be beneficial in that operation of the pump may be selectively controlled by the manner in which the solenoid is operated; for example, the time periods for which the solenoid is energised and de-energised. By way of example, in one mode of operation of the pump 15, the displacement stroke of the pump, as represented by movement of the piston 23 in the first direction to perform a pumping stroke, may be controlled linearly by controlling the electrical control signal input for energising the solenoid 16. In other words, the stroke length of the piston 23 may be selectively varied by controlling the period of time during which the solenoid is energised by the electrical control signal input. In another mode of operation of the pump 15, the stroke rate of the pump, as represented by the speed at which the piston 23 moves back-and-forth, may be controlled by controlling the electrical control signal input for operation of the solenoid. In other words, the stroke rate of the piston 23 may be selectively varied by controlling the time periods for which the solenoid is energised and de-energised, and also the intensity of the energisation.

The control of the electrical signal input for the solenoid 16 may be performed in any appropriate way as would be understood by a person skilled in the art; for example, the control may be by way of pulse width modulation or pulse frequency modulation.

With this arrangement, the pumping operation of the pump 15 can be regulated according to the vapour cavity entrainment condition within the lubrication oil; that is, for example, according to the extent of, and the nature of, entrained vapour cavities in the lubrication oil being delivered by the pump. Put simply, the number of, and the size of, bubbles within the lubrication oil may be indicative of, or represent, the vapour cavity entrainment condition.

In relation to regulating the pumping operation of the pump 15 according to the vapour cavity entrainment condition within the lubrication oil, there may, for example, be circumstances in which it is beneficial to deliver the lubrication oil using pumping strokes of different lengths. More particularly, in some cases it may be advantageous to use relatively longer pumping strokes and in other cases relatively shorter pumping strokes. This can be achieved by appropriate variation of the stroke length through regulating the electrical control signal input for operation of the solenoid. There may also, for example, be circumstances in which it is beneficial to deliver the lubrication oil using pumping strokes at different rates. More particularly, in some cases it may be advantageous to use faster pumping strokes and in other cases slower pumping strokes. This can be achieved by appropriate variation of the stroke rate through regulating the electrical control signal input for operation of the solenoid. A combination of variation in both stroke length and stroke rate may also be performed; for example, a pumping action involving relatively fast, short pumping strokes, or a pumping action involving relatively short, long strokes, or a pumping action involving any other combination of stroke rate and stroke length.

In one arrangement, the variation can be pre-set or otherwise predetermined according to, for example, a known condition of the lubrication oil or likely operation of the engine lubrication system in a certain environment. In another arrangement, the variation can be performed during actual operation of the engine. In this latter arrangement, the variation may be performed according to, for example, a condition which the engine encounters or to which the engine is likely to be exposed during operation, such as an ambient temperature condition, an ambient air pressure condition at altitude, or adverse turbulence.

The effectiveness of operation of inlet and outlet check valves 27, 28 can be vulnerable to the presence of vapour cavities within the lubrication oil flow being controlled by the valves. Regulation of the operation of the pump 15 in the manner described above can assist in ensuring reliable operation of the valve system 26 notwithstanding the presence of vapour cavities in the lubrication oil, and thus reliable operation of the pump 15 more generally.

Referring now to FIGS. 1 to 6, there is shown a first embodiment of the engine lubrication system 10. The solenoid actuated positive displacement pump 15 is shown in FIG. 3.

Figure 2:
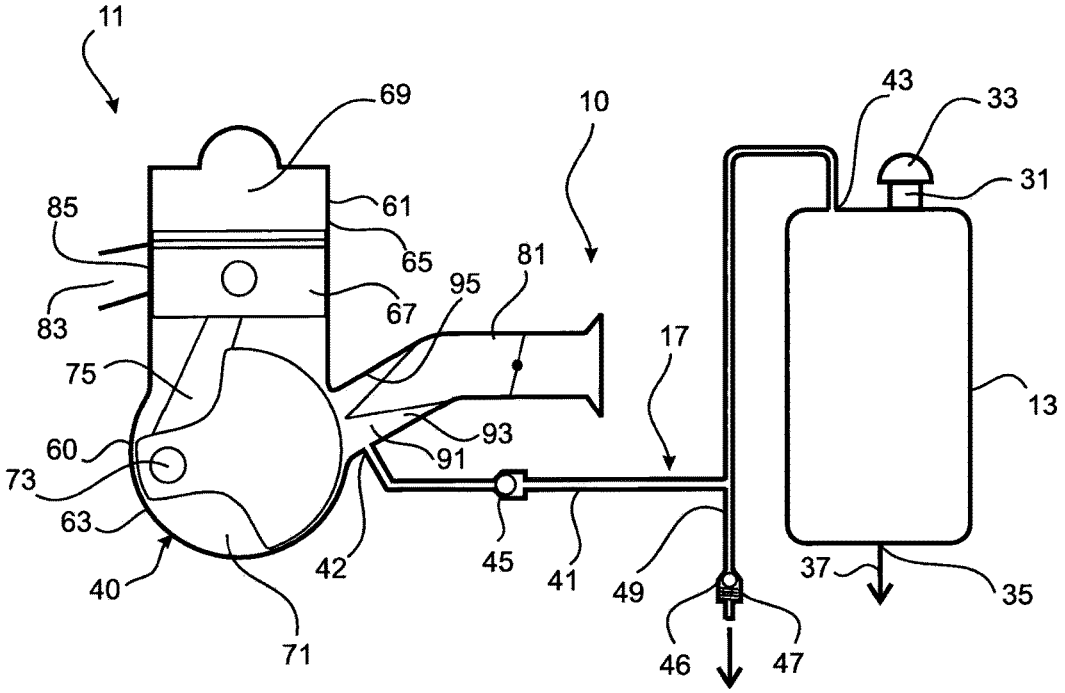
FIG. 2 is a view similar to FIG. 1 but on a larger scale showing further detail.

In this first embodiment, the engine lubrication system 10 utilises crankcase pressure of the engine 11 as the fluid pressure source 40. In particular, the engine 11 is a two-stroke crankcase compression engine comprising an engine body 60 having a cylinder head 61 and an engine block 63, as best seen in FIG. 2. The cylinder head 61 defines a cylinder 65 in which there is a piston 67 which cooperates with the cylinder to define a combustion chamber 69. The engine block 63 defines a crankcase 71 which accommodates a crankshaft 73 which is connected to the piston 67 by connecting rod 75 in known manner.

The engine 11 has an air intake 81 through which intake air is delivered to the crankcase 71 in known manner. The engine 11 also has an exhaust outlet 83 communicating with the cylinder 65 via an exhaust port 85, again in known manner.

With this arrangement, the engine 11 utilizes crankcase compression to deliver combustion air from the crankcase 71 to the cylinder 65 at which it is subjected to compression in the combustion chamber 69.

The air intake 81 incorporates a one-way valve 91 to permit intake air to enter the crankcase 71 while preventing flow in the reverse direction. In the arrangement shown the one-way valve 91 is configured as a reed valve arrangement 93 of known type. It is, however, to be understood that other valve arrangements such as for example piston-ported or rotary valves could alternatively be used in the air-intake 81, and that the use of such arrangements also fall within the scope of the present invention.

Figure 4:
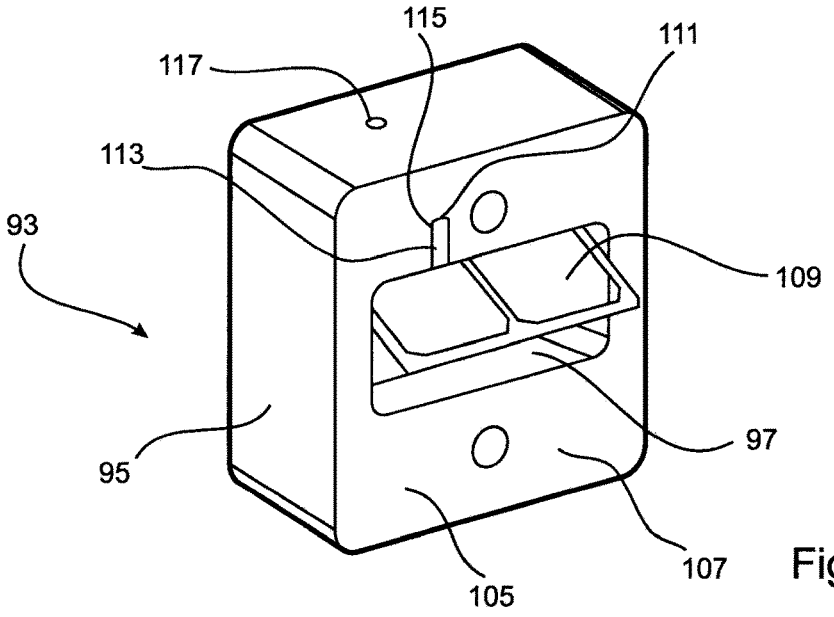
FIG. 4 is a schematic perspective view of a reed valve arrangement for the two-stroke engine, the arrangement being configured to facilitate fluid communication between the crankcase of the engine and an oil reservoir forming part of the engine lubrication system according to the first embodiment.
Figure 5:
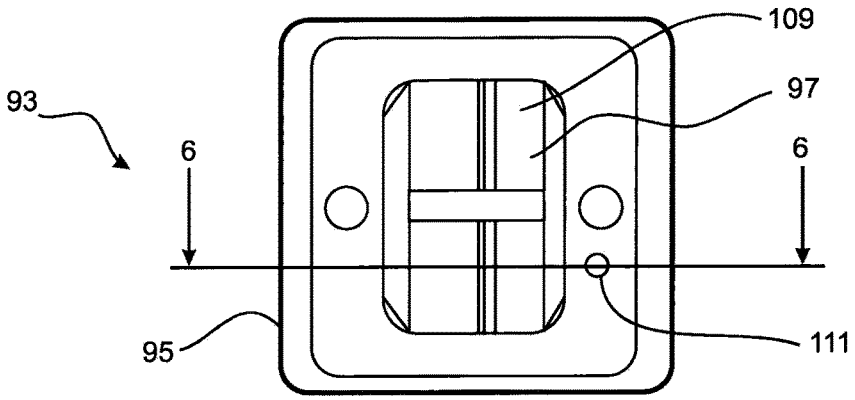
FIG. 5 is a view of an inlet side of the reed valve arrangement.
Figure 6:
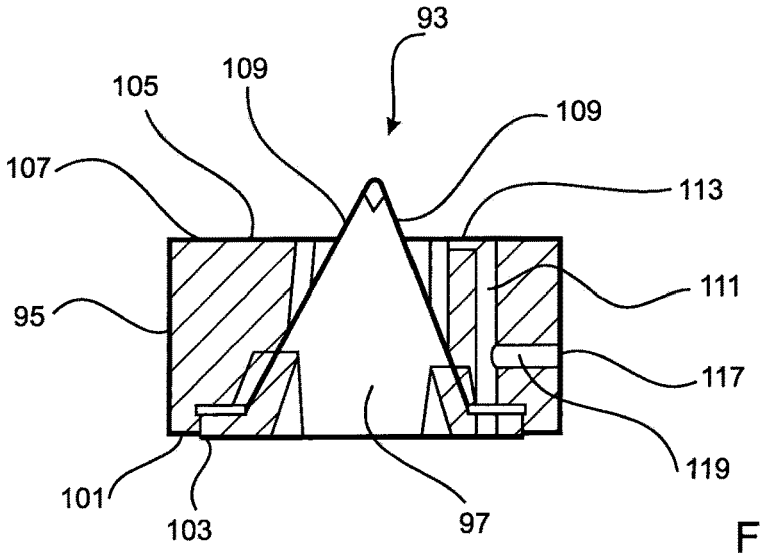
FIG. 6 is a cross-sectional view on line 6-6 of FIG. 5.

As best seen in FIGS. 4, 5 and 6, the reed valve arrangement 93 comprises a valve body 95 adapted to be installed in the inlet 81. The valve body 95 has a flow path 97 extending between an upstream side 101 defined by end face 103 and downstream side 105 defined by end face 107. A reed valve 109 is accommodated within the flow path 97. The body 95 also incorporates a fluid gallery 111 which would normally provide a path for communication with a temperature sensor.

The arrangement described so far in relation to the reed valve arrangement 93 is well-known. However, for the purposes of the present embodiment, the valve body 95 is modified to facilitate use of the reed valve arrangement 93 as an access point for fluid pressure within the crankcase, thereby allowing crankcase compression to be used as the source of fluid pressure 40.

In the arrangement shown, the modification comprises incorporation of a further flow gallery 113 between the fluid gallery 111 and the flow path 97 within the valve body 95, as shown in FIG. 6. In the arrangement shown, the further flow gallery 113 is formed by machining a ball nose slot 115 in the end face 107. The modification further comprises installation of a tapping point 117 incorporating a port 119 communicating with the fluid gallery 111. With this arrangement, the tapping point 117 is in fluid communication with the crankcase 71 to receive crankcase pressure pulses therefrom.

The inlet 42 of the fluid pressure supply line 41 is connected to the tapping point 117 so that pressure pulses can be received from the crankcase 71 during crankcase compression to provide a supply of compressed air for pressurising the oil tank 13 as previously described.

Figure 7:
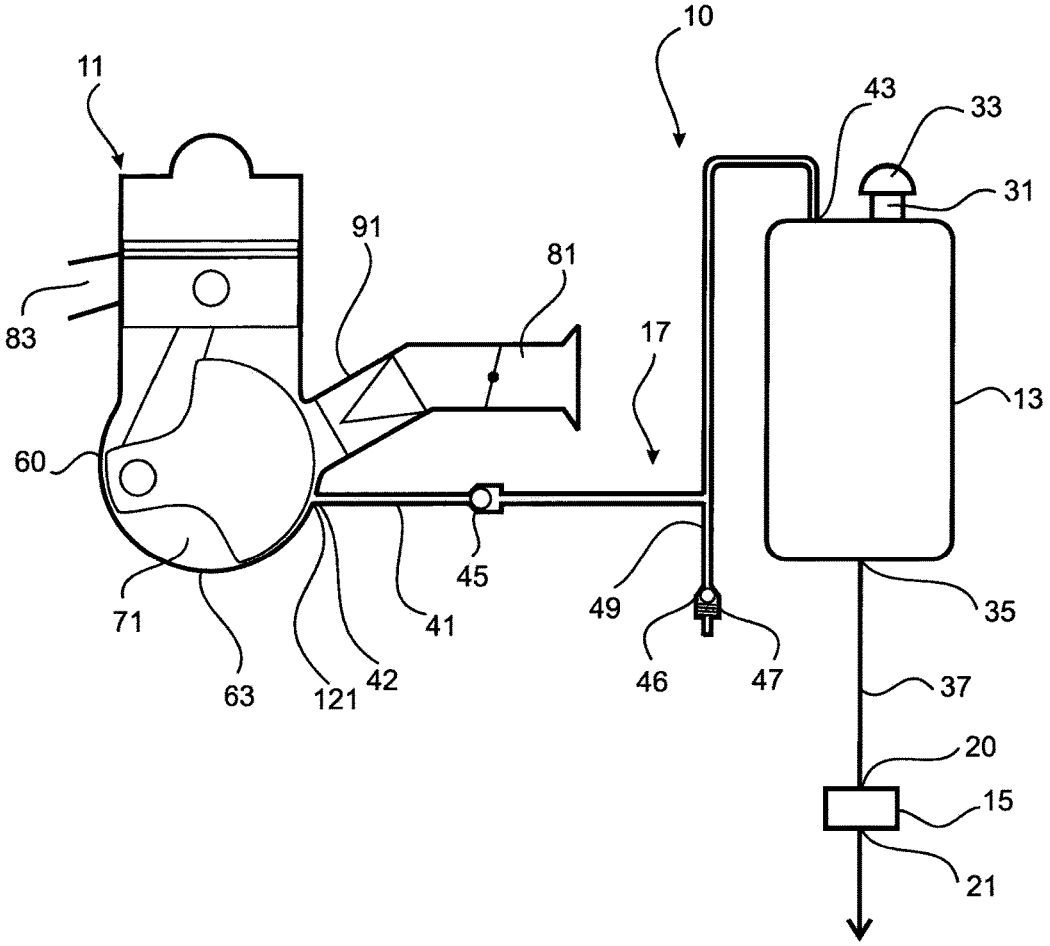
FIG. 7 is a schematic view of a second embodiment of the engine lubrication system according to the invention fitted to a two-stroke engine.

With such an arrangement, the crankcase of the two-stroke engine functions as the fluid pressure source 40, supplying pulses of compressed air along the fluid pressure supply line 41 to the oil tank 13, Referring now to FIG. 7, there is shown a second embodiment of the engine lubrication system 10.

As is the case with the first embodiment, this second embodiment utilises crankcase compression of the engine 11 as the fluid pressure source 40. However, in this second embodiment, the inlet 42 of the fluid pressure supply line 41 is tapped into the engine block 63 at tapping point 121 to communicate directly with the crankcase 71. The tapping point 121 is preferably remote from the point at which lubrication oil is introduced into the crankcase 71. Indeed, it is desirable that the tapping point 121 be on the opposed side of the crankcase 71 to the point at which lubrication oil is introduced into the crankcase. The solenoid actuated positive displacement pump 15 used in this second embodiment is similar to that used in the first embodiment as shown in FIG. 3.

The engine lubrication system 10 need not necessarily use crankcase pressure of the engine 11 as the fluid pressure source 40. Embodiments utilising several arrangements not involving crankcase compression for the fluid pressure source 40 will now be described.

Figure 8:
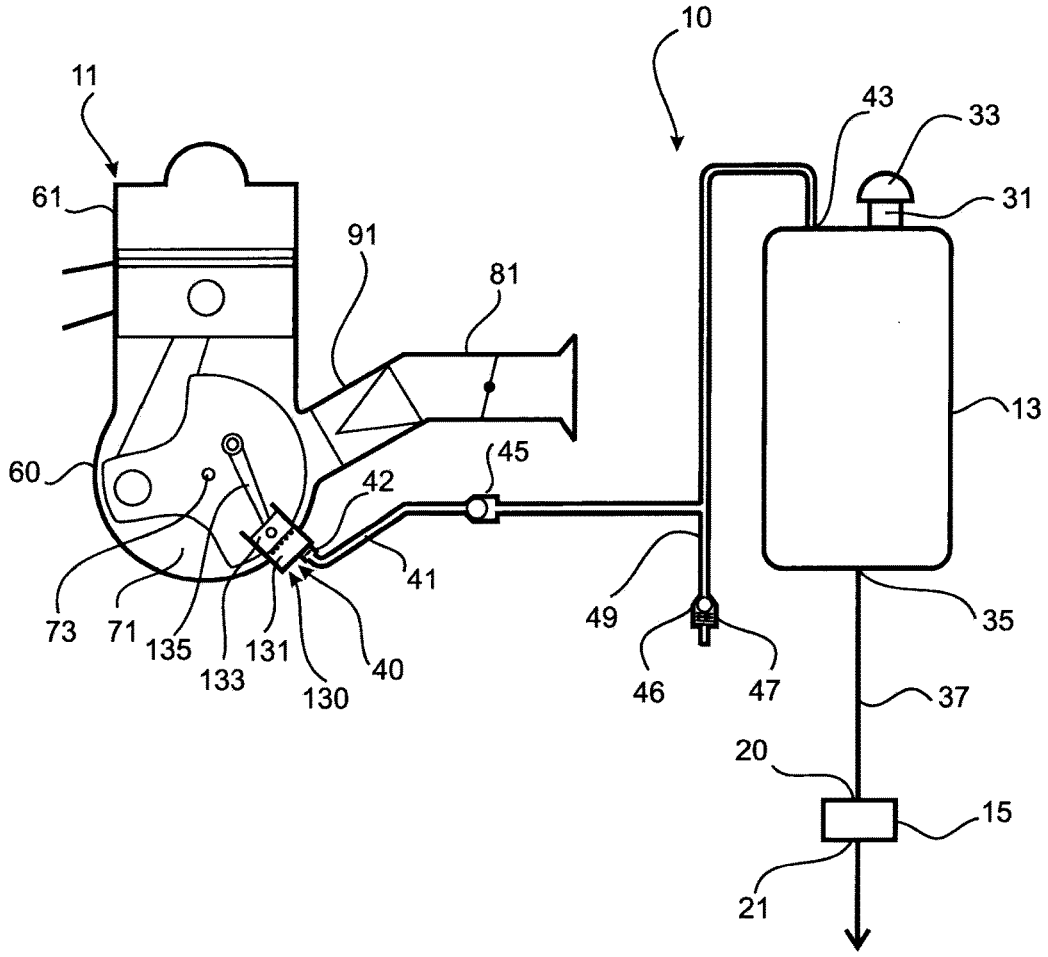
FIG. 8 is a schematic view of a third embodiment of an engine lubrication system according to the invention fitted to a two-stroke engine.

Referring now to FIG. 8, there is shown a third embodiment of the engine lubrication system 10. In this third embodiment, the fluid pressure source 40 comprises an air compressor 130 for delivering compressed air as the pressurising fluid. In the arrangement illustrated, the air compressor 130 is integral with the engine 11 and is driven by the engine. In particular, the air compressor 130 comprises a reciprocating piston and cylinder arrangement 131, with the piston 133 being connected to the crankshaft 73 of the engine 11 by connecting rod 135. The solenoid actuated positive displacement pump 15 used in this third embodiment is similar to that used in the first embodiment as shown in FIG. 3.

It should, however, be understood that other compressor arrangements are possible for use with the present invention. By way of example, the air compressor may be mounted on the UAV separately of the engine 11. Additionally, and where appropriate, the air compressor may be driven separately of the engine 11, such as for example by an onboard electric motor.

Figure 9:
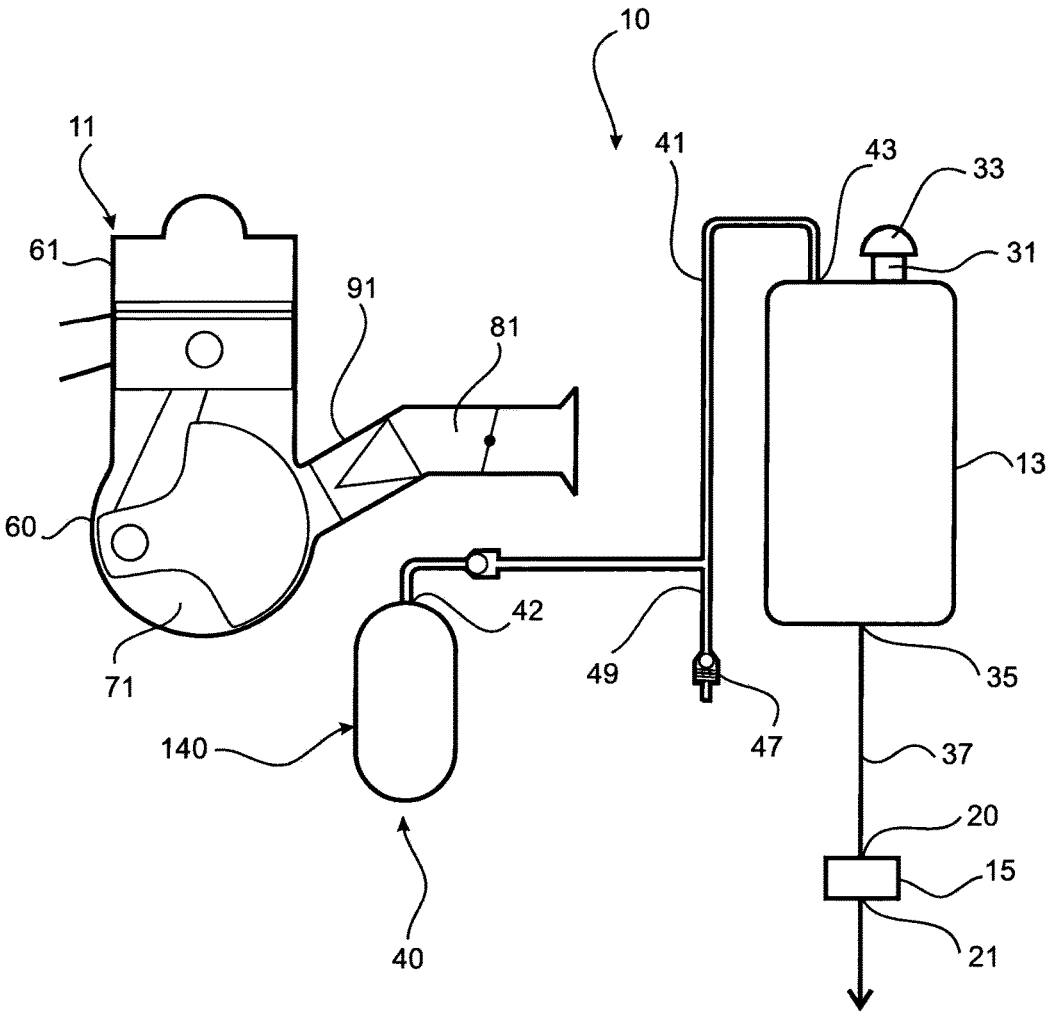
FIG. 9 is a schematic view of a fourth embodiment of the engine lubrication system according to the invention fitted to a two-stroke engine.

Referring now to FIG. 9, there is shown a fourth embodiment of the engine lubrication system 10. In this fourth embodiment, the fluid pressure source 40 comprises a fluid pressure vessel 140 containing a supply of compressed fluid mounted onboard the UAV. The compressed fluid would typically comprise compressed air. With this arrangement, the fluid pressure vessel 140 would be replenished with compressed fluid as necessary between flights of the UAV. The solenoid actuated positive displacement pump 15 used in this fourth embodiment is similar to that used in the first embodiment as shown in FIG. 3.

Figure 10:
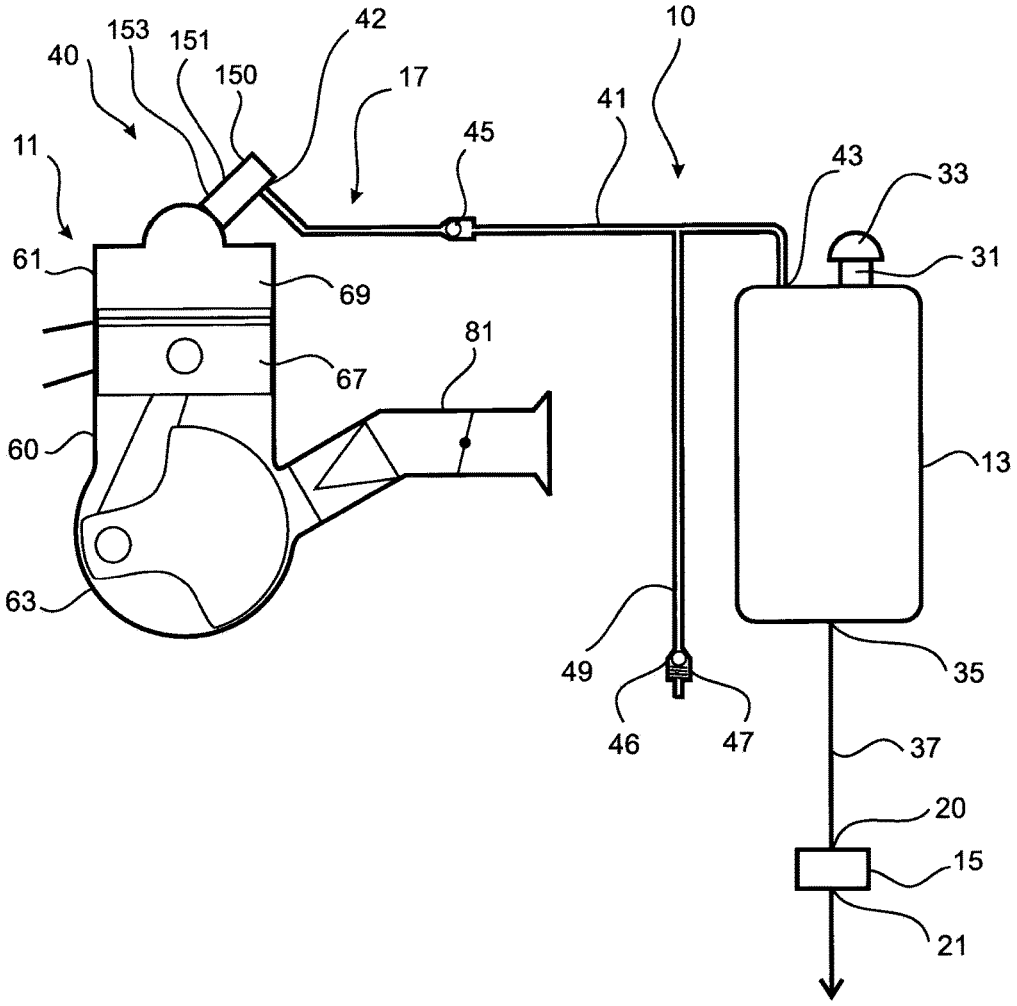
FIG. 10 is a schematic view of a fifth embodiment of an engine lubrication system according to the invention fitted to a two-stroke engine.

Referring now to FIG. 10, there is shown a fifth embodiment of the engine lubrication system 10. In this fifth embodiment, the fluid pressure source 40 comprises a pressurised air supply arrangement 150 for an air-assist (dual fluid) fuel injection system 151 installed on the engine 11 of the UAV. In this embodiment, the engine comprises a two-stroke direct injection engine, although it need not be so. The air-assist fuel injection system 151 is of known kind and comprises an integrated air/fuel rail 153 having an air path (not shown) configured to receive compressed air for use in assisting in the direct injection of fuel into the engine.

With this arrangement, the inlet 42 of the fluid pressure supply line 41 is tapped into, or is otherwise fluidly connected to, the air path integrated into the air/fuel rail 151. In some arrangements when this air path is used as the supply of compressed air for the oil tank 13, there may exist a need to regulate the fluid pressure down to a level appropriate for pressurisation of the oil tank 13 for the intended purpose as described. This regulation would be achieved in the known manner by inclusion or an air regulator or the like at a desired location (not shown in FIG. 10), for example along the supply line 41. The solenoid actuated positive displacement pump 15 used in this fifth embodiment is similar to that used in the first embodiment as shown in FIG. 3.

From the foregoing, it is evident that the present invention provides a simple yet highly effective arrangement for reliably supplying oil to the engine of a UAV while in flight, regardless of the presence of vapour cavities which might normally form in the oil during operating conditions likely to be encountered in flight.

As mentioned above, the engine lubrication system 10 may be assembled by retrofitting the pressurisation system 17 to an existing engine 11 and utilising the original oil pump 15 and oil tank 13 of the engine system. In such a case, it would only be necessary to provide the pressurisation system 17 for installation on the engine. In the case of the first embodiment, it would also be necessary to modify the engine 11, either by modifying the existing reed valve arrangement 93 or alternatively providing a replacement reed valve arrangement configured for the purpose. In the case of the second embodiment, it would be necessary to modify the engine 11 by installing the tapping point 121 in the engine block 63 for communication with the crankcase 71 to receive crankcase pressure. In the case of the third embodiment, it would be necessary to modify the engine 11 to incorporate the onboard compressor 130 if the latter were to be driven by the engine. No modification to the engine 11 would likely be required in relation to installation of the fourth embodiment.

Also as mentioned above, the engine lubrication system 10 could be supplied as an integrated unit with the engine; that is, the engine lubrication system 10 could be installed on the engine on an OEM basis, with the oil tank 13, oil pump 15 and pressurisation system 17 integrated with the engine as originally supplied.

In the various embodiments described and illustrated, lubrication oil has been pressured by introducing a pressurised gas or gaseous mixture directly to the oil tank 13 such that the space above the lubrication oil within the tank is pressured above ambient pressure. Other arrangements are, of course, possible. By way of example, the lubrication oil may be contained within a sealed flexible bag or bladder, with fluid pressure being applied to the exterior of the bag or bladder to cause the bag or bladder to deform and thereby pressurise the oil. In such an arrangement, the fluid pressure is indirectly applied to the oil to achieve pressurisation thereof.

Still further, it should be understood that for certain engine applications yet other sources of gas pressure could be arranged for use with the present invention. For example, for some engine applications, a supercharger or turbocharger coupled to the engine in the known manner could also be arranged to provide a controlled source of pressure to pressurise an oil reservoir of the lubrication system.

Modifications and improvements may be made without departing from the scope of the invention. In particular, while the present invention has been described in terms of a preferred embodiment in order to facilitate better understanding of the invention, it should be appreciated that various modifications can be made without departing from the principles of the invention. Therefore, the invention should be understood to include all such modifications within its scope.

Reference to positional descriptions, such as "lower", "upper", "top" and "bottom" are to be taken in context of the embodiment depicted in the drawings, and are not to be taken as limiting the invention to the literal interpretation of the term but rather as would be understood by the skilled addressee.

Additionally, where the terms "system", "device", "apparatus" are used in the context of the invention, they are to be understood as including reference to any group of functionally related or interacting, interrelated, interdependent or associated components or elements that may be located in proximity to, separate from, integrated with, or discrete from, each other.

The invention described herein includes a range of preferred pressure values for pressurising the oil. A range of values will be understood to include all values within the range, including the values defining the range, and values adjacent to the range which lead to the same or substantially the same outcome as the values immediately adjacent to that value which defines the boundary to the range.

Throughout this specification, unless the context requires otherwise, the word "comprise" or variations such as "comprises" or "comprising", will be understood to imply the inclusion of a stated integer or group of integers but not the exclusion of any other.

What is claimed is:

1. An engine lubrication system for an unmanned vehicle, the lubrication system comprising a lubrication oil reservoir, a solenoid-actuated positive displacement pump to deliver lubrication oil to the engine from the reservoir, a pressurisation system for pressurising oil received by the pump from the reservoir for delivery to the engine, the pressurisation system being operable to use fluid pressure generated by crankcase compression of the engine for establishing a positive pressure at the pump inlet for all engine operating conditions, whereby the positive pressure assists delivery of oil having entrained vapour cavities to the engine for lubrication thereof and improves metering accuracy of the pumped oil when the unmanned vehicle is at altitude, and a pressure regulation system for relieving excess pressure upon the lubrication oil to be received and delivered by the oil pump while maintaining said positive pressure at the pump inlet, and wherein operation of the solenoid-actuated positive displacement pump is selectively variable according to vapour cavity entrainment within the lubrication oil.

2. The engine lubrication system according to claim 1, wherein the pump comprises an electromagnetically actuated reciprocating piston pump.

3. The engine lubrication system according to claim 2, further comprising an electronic control system for controlling actuation of the solenoid, the electronic control system being operable to regulate an electrical control signal input for operation of the solenoid according to when and the manner in which the pump is required to operate.

4. The engine lubrication system according to claim 1, wherein the pressurisation system is operable to pressurise oil within the oil reservoir.

5. The engine lubrication system according to claim 4, wherein the oil reservoir is adapted to be pressurised by fluid pressure within or acting upon the oil reservoir.

6. The engine lubrication system according to claim 5, further comprising a fluid pressure delivery path extending between the engine crankcase and the oil reservoir, and a valve in communication with the delivery path to permit fluid flow from the engine crankcase to the oil reservoir while restricting fluid flow in the opposition direction.

7. The engine lubrication system according to claim 1, wherein the pressure regulation system is operable to relieve excess fluid pressure within the oil reservoir.

8. The engine lubrication system according to claim 7, wherein the pressure regulation system comprises a pressure relief valve.

9. A pressurisation system operable to pressurise oil flowing to an oil pump within an engine lubrication system of an unmanned vehicle, the pressurisation system comprising a source of fluid pressure and a fluid flow path between the source of fluid pressure and an oil reservoir from which lubrication oil can flow to the oil pump, whereby the pressurisation establishes a positive pressure at the pump inlet for all engine operating conditions to assist delivery of lubrication oil having entrained vapour cavities to the engine for lubrication thereof and to improve metering accuracy of the pumped oil when the unmanned vehicle is at altitude, and a pressure regulation system for relieving excess fluid pressure upon the oil to be received and delivered by the oil pump while maintaining said positive pressure at the pump inlet, wherein the source of fluid pressure comprises fluid pressure generated by crankcase compression of the engine.

10. The pressurisation system according to claim 9 wherein said positive pressure at the pump inlet is established by pressurisation of the oil within the reservoir.

11. The pressurisation system according to claim 10, wherein oil within the reservoir is pressurised by fluid pressure within or acting upon the oil reservoir.

12. A method of delivering lubrication oil to an engine of an unmanned vehicle, the method comprising using crankcase compression of the engine to generate fluid pressure for pressurising a supply of the lubrication oil to be received by a pump, and operating the pump to deliver lubrication oil to the engine, wherein the pressurisation of the lubrication oil establishes a positive pressure at the pump inlet for all engine operating conditions to assist delivery of lubrication oil having entrained vapour cavities and to improve metering accuracy of the pumped oil when the unmanned vehicle is at altitude, wherein the pressure at the pump inlet is regulated to not exceed a prescribed maximum while maintaining said positive pressure at the pump inlet, wherein the pump comprises a solenoid-actuated positive displacement pump and wherein operation of the pump is selectively variable according to vapour cavity entrainment within the lubrication oil.

13. The method according to claim 12, wherein selective variation of operation of the pump comprises at least one of varying the stroke length and stroke rate of a pumping cycle performed by the pump.

14. A method of delivering lubrication oil to an engine of an unmanned vehicle, the method comprising pressurising a supply of the lubrication oil to be received by a pump, the supply of oil being pressurized by crankcase compression of the engine, and operating the pump to deliver lubrication oil to the engine, wherein the pressurisation of the lubrication oil establishes a positive pressure at the pump inlet for all engine operating conditions to assist delivery of lubrication oil having entrained vapour cavities and to improve metering accuracy of the pumped oil when the unmanned vehicle is at altitude, and wherein the method further comprises relieving excess fluid pressure upon the oil to be received and delivered by the oil pump while maintaining said positive pressure at the pump inlet.

15. An engine lubrication system for an unmanned vehicle, the lubrication system comprising a lubrication oil reservoir, an electronic oil pump to deliver lubrication oil to the engine from the reservoir, a pressurisation system for pressurising oil received by the pump from the reservoir for delivery to the engine, wherein the pressurisation system is operable to use fluid pressure generated by crankcase compression of the engine for establishing a positive pressure at the pump inlet for all engine operating conditions, whereby the positive pressure assists delivery of oil having entrained vapour cavities to the engine for lubrication thereof and improves metering accuracy of the pumped oil when the unmanned vehicle is at altitude, and a pressure regulation system for relieving excess pressure upon the lubrication oil to be received and delivered by the oil pump while maintaining said positive pressure at the pump inlet, wherein operation of the electronic oil pump is selectively variable according to vapour cavity entrainment within the lubrication oil.

16. The engine lubrication system according to claim 15, wherein the electronic oil pump comprises an electromagnetically actuated pump, the electromagnetically actuated pump comprising an electromagnetically actuated reciprocating piston pump.

17. A two-stroke direct injection engine, the engine comprising a combustion chamber to receive fuel for combustion by direct injection and an lubrication system for delivery of lubrication oil to the engine, the lubrication system comprising an engine lubrication system according to claim 1.

18. A two-stroke direct injection engine, the engine comprising a combustion chamber to receive fuel for combustion by direct injection and an lubrication system for delivery of lubrication oil to the engine, the lubrication system comprising an engine lubrication system according to claim 15.

19. The engine lubrication system according to claim 5, wherein the fluid pressure within or acting upon the oil reservoir is within a range between 10 and 15 kPa above ambient pressure.

20. The pressurisation system according to claim 11, wherein the fluid pressure within or acting upon the oil reservoir is within a range between 10 and 15 kPa above ambient pressure.

21. The method according to claim 12 wherein the supply of the lubrication oil to be received by a pump is pressurised by fluid pressure within or acting upon a reservoir for the lubrication oil.

22. The method according to claim 21 wherein the fluid pressure within or acting upon the reservoir is within a range between 10 and 15 kPa above ambient pressure.

23. The method according to claim 14 wherein the supply of the lubrication oil to be received by a pump is pressurised by fluid pressure within or acting upon a reservoir for the lubrication oil.

24. The method according to claim 23 wherein the fluid pressure within or acting upon the reservoir is within a range between 10 and 15 kPa above ambient pressure.

25. The engine lubrication system according to claim 15, wherein the pressurisation system is operable to pressurise oil within the oil reservoir.

26. The engine lubrication system according to claim 25, wherein the oil reservoir is adapted to be pressurised by fluid pressure within or acting upon the oil reservoir, and wherein the fluid pressure is within a range between 10 and 15 kPa above ambient pressure.

27. The engine lubrication system according to claim 1 wherein the unmanned vehicle comprises an unmanned aerial vehicle.

28. The pressurization system according to claim 9 wherein the unmanned vehicle comprises an unmanned aerial vehicle.

29. The method according to claim 12 wherein the unmanned vehicle comprises an unmanned aerial vehicle.

30. The method according to claim 29, wherein the supply of lubrication oil is pressurised while the unmanned aerial vehicle is in flight.

31. The method according to claim 14, wherein the pump comprises a solenoid-actuated positive displacement pump, and wherein operation of the pump is selectively variable according to vapour cavity entrainment within the lubrication oil.

32. The method according to claim 31 wherein selective variation of operation of the pump comprises at least one of varying the stroke length and stroke rate of a pumping cycle performed by the pump.

33. The method according to claim 14 wherein the unmanned vehicle comprises an unmanned aerial vehicle.

34. The method according to claim 33, wherein the supply of lubrication oil is pressurised while the unmanned aerial vehicle is in flight.

35. The engine lubrication system according to claim 15 wherein the unmanned vehicle comprises an unmanned aerial vehicle.

* * * * *